US008124306B2

(12) United States Patent
Hirata et al.

(10) Patent No.: US 8,124,306 B2
(45) Date of Patent: Feb. 28, 2012

(54) MAGNETIC TONER

(75) Inventors: Junko Hirata, Suntou-gun (JP); Yoshihiro Ogawa, Yokohama (JP); Yusuke Hasegawa, Suntou-gun (JP); Kouji Nishikawa, Suntou-gun (JP); Miho Okazaki, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 685 days.

(21) Appl. No.: 12/298,755

(22) PCT Filed: Apr. 25, 2007

(86) PCT No.: PCT/JP2007/059412

§ 371 (c)(1),
(2), (4) Date: Oct. 27, 2008

(87) PCT Pub. No.: WO2007/126125

PCT Pub. Date: Nov. 8, 2007

(65) Prior Publication Data

US 2009/0186288 A1 Jul. 23, 2009

(30) Foreign Application Priority Data

Apr. 28, 2006 (JP) ..... 2006-124750

(51) Int. Cl.
*G03G 9/083* (2006.01)

(52) U.S. Cl. ..... 430/106.2; 430/106.1

(58) Field of Classification Search ..... 430/106.1, 430/106.2

See application file for complete search history.

(56) References Cited

U.S. PATENT DOCUMENTS

| | | | | |
|---|---|---|---|---|
| 4,526,851 | A * | 7/1985 | Boughton et al. | 430/106.2 |
| 5,663,026 | A | 9/1997 | Kasuya et al. | 430/106 |
| 6,316,157 | B1 | 11/2001 | Yoshikawa et al. | |
| 6,653,036 | B1 | 11/2003 | Tanikawa et al. | 430/106.2 |
| 7,368,211 | B2 | 5/2008 | Hasegawa et al. | |
| 2003/0054276 | A1 * | 3/2003 | Moriyama et al. | 430/106.2 |
| 2004/0081905 | A1 | 4/2004 | Moribe et al. | 430/108.3 |
| 2006/0035163 | A1 | 2/2006 | Moribe et al. | 430/108.3 |
| 2006/0121379 | A1 | 6/2006 | Dojo et al. | 430/106.1 |
| 2006/0177753 | A1 | 8/2006 | Moribe et al. | 430/108.3 |
| 2006/0199093 | A1 * | 9/2006 | Iinuma et al. | 430/111.31 |
| 2007/0254157 | A1 * | 11/2007 | Uchida et al. | 428/403 |
| 2008/0286676 | A1 * | 11/2008 | Yoshiba et al. | 430/106.2 |

FOREIGN PATENT DOCUMENTS

| | | | |
|---|---|---|---|
| CN | 1758147 | A | 4/2006 |
| JP | 07-175262 | | 7/1995 |
| JP | 07-271089 | | 10/1995 |
| JP | 08-272136 | | 10/1996 |
| JP | 10-073950 | | 3/1998 |
| JP | 10-221881 | A | 8/1998 |
| JP | 11-153882 | | 6/1999 |
| JP | 2000-29246 | A | 1/2000 |
| JP | 2000-335920 | | 12/2000 |
| JP | 2002-169328 | | 6/2002 |
| JP | 2002-323794 | | 11/2002 |
| JP | 2003-122044 | | 4/2003 |
| JP | 2003-195560 | A | 7/2003 |
| JP | 2004-117957 | A | 4/2004 |
| JP | 2004-139071 | | 5/2004 |
| JP | 2005-157318 | | 6/2005 |
| JP | 2005-170689 | | 6/2005 |
| JP | 2005-265958 | A | 9/2005 |
| JP | 2005-316057 | A | 11/2005 |
| WO | WO 2004088680 | A2 * | 10/2004 |
| WO | 2005/043251 | A1 | 5/2005 |

OTHER PUBLICATIONS

Official Action dated Jan. 31, 2011 in Chinese Application No. 200780015155.0.

Search Report dated Jul. 22, 2011 in European Application No. 07742847.2.

* cited by examiner

*Primary Examiner* — Christopher Rodee

(74) *Attorney, Agent, or Firm* — Fitzpatrick, Cella, Harper & Scinto

(57) ABSTRACT

The object of the present invention is to provide a magnetic toner enabling an image with high image density and excellent image reproducibility to be obtained, which is excellent in fluidity, charging stability, and charging uniformity, even for long-term use, and also enabling an image whose fogging, ghost, and scattering are suppressed to be obtained. The magnetic toner has at least a binder resin and a magnetic material, where, the magnetic material is an magnetic iron oxide whose dielectric breakdown voltage of the magnetic material is 160 to 1600 V/cm, and the dielectric loss tangent (tan δ) of the magnetic toner at 100 kHz and 40° C. is $2.0\times10^{-3}$ to $1.0\times10^{-2}$.

3 Claims, No Drawings

MAGNETIC TONER

TECHNICAL FIELD

The present invention relates to a magnetic toner for use in image forming methods such as electrophotography, electrostatic printing, a magnetic recording method, and a toner jet recording method.

BACKGROUND ART

Although many methods are known, as electrophotography, a method in which an transferred object is obtained by forming an electric latent image (electrostatic latent image) on a photosensitive member by various means utilizing a photoconductive material, next, developing the latent image using a toner, and if necessary, transferring the toner image on a transfer material such as paper, and subsequently, fixing the toner image by means of heating, pressing, hot pressing, or a solvent vapor, and remaining developer which is not transferred on the photosensitive member is cleaned by means of various methods, and the above-mentioned steps are repeated is generally used.

Among those, as a development system, an one component developing system is used preferably, because a developing machine of the system has a simple structure, few troubles, long life, and is easily maintained.

In such a developing system, the quality of a formed image depends largely on the performance of a magnetic toner. In the magnetic toner, a great deal of fine powder-like magnetic iron oxide is mixed and dispersed, and a part of the magnetic iron oxide is exposed on the surface of the magnetic toner. For this reason, the kind of the magnetic iron oxide influences the fluidity and the triboelectric charging characteristic of the magnetic toner, and, as a result, influences various characteristics required to the magnetic toner, such as the magnetic toner developing property and durability. Therefore, previously, with regard to the magnetic iron oxide contained in the magnetic toner, a great number of proposals have been performed.

As magnetic iron oxides, a magnetic iron oxide has been known, which contains Si and has a specified Fe/Si atom ratio on the surface of the magnetic iron oxide, and which has been subjected to a surface treatment with Al further (Japanese Patent Application Laid-Open No. H07-175262). According to such a magnetic iron oxide, although a toner could have excellent fluidity and could have stable charging characteristic even under high temperature and high humidity, problems in image quality such as a ghost and scattering due to the charging characteristic in a high-speed developing system have not been improved yet, resulting in room of improvement.

Moreover, as magnetic iron oxides, a magnetic iron oxide has been known, which contains Al and has been subjected to a hydrophobizing treatment and thereby has a specified magnetic properties (Japanese Patent Application Laid-Open No. H07-271089). In these magnetic iron oxides, a part or all of trivalent iron ions are replaced with Al, and the saturation magnetization value thereof is thus low. By using such magnetic iron oxides, a toner can be obtained, where magnetic cohesive force acting between toner particles is weak and the consumption amount of the toner can be thus reduced. Moreover, a toner can be obtained, which has a good shelf life even under high temperature and high humidity environment and can maintain sufficient image density and for which occurrence of fogging and tailing is suppressed. Moreover, since the amount of covalent irons and the amount of FeO in magnetite are maintained, it is possible to provide a magnetic toner whose degree of blackness is good. However, with regard to degradation of image quality due to unevenness of charging when it was used for a long period of time and instability of image quality under a low temperature and low humidity condition, they have not been investigated sufficiently.

In magnetic iron oxides, a magnetic iron oxides have been known, which contains Si element and Al element and has a specified Si and Al content ratio on the magnetic iron oxide surface (Japanese Patent Application Laid-Open No. H08-272136). By using such a magnetic iron oxide, a toner can be obtained, where the controllability of electrification thereof can be enhanced more than ever before, and, even in case of continuous image formation under a low temperature and low humidity environment, homogeneity of coating on a toner carrier is excellent. And, when such a magnetic toner is used, even in a solid image, image defects such as a thin spot/wave-like irregularity, are suppressed, thus enabling to obtain a high definition and sharp image. However, with regard to the stability of the image density under a high temperature and high humidity environment, has no been sufficiently investigated.

Moreover, as magnetic iron oxides, a magnetic iron oxides has been known, which contains one or more elements selected from the group of elements consisting of Li, Be, B, Mg, Al, Si, P, Ge, Ti, Zr, Sn, and Zn (Japanese Patent Application Laid-Open No. H10-073950). Such a magnetic iron oxide is excellent in the dispersibility into binder resin, and can stabilize the electrification characteristic of a toner. In addition, in the recent trend of decreasing particle size of the toner, excellent charging uniformity can be achieved even when a toner whose average particle size is equal to or smaller than 10 μm is used, the cohesiveness of the toner is also reduced, and high image density can be achieved, thus enabling to achieve image formation excellent in developing performance, where fogging is suppressed. However, with regard to improvement in the dot reproducibility and reduction of tailing from a viewpoint of electrification characteristic, and improvement of environmental stability, they have not been sufficiently investigated.

As magnetic iron oxides containing a different kind of element, a magnetic iron oxide has been known, which contains one or more elements selected from the element group consisting of Mg, Na, K, Ca, Li, Ti, S, Al, Si, B, and C outside the central part thereof, and whose true specific gravity at 20° C. is greater than 4 and smaller than 5.2 (Japanese Patent Application Laid-Open No. 2000-335920). In such a magnetic iron oxide, balancing of magnetic properties is good, true density thereof is small, and mixing performance thereof with resin is also good. In addition, when it is used for magnetic toners, a magnetic toner can be obtained, which provides high image density, and little fogging, and has a few magnetic iron oxide particles dropping out of toner particles. However, with regard to improvement of image quality and environmental stability, there has been room of investigation.

Moreover, a magnetic material has been known, which contains one or more metal elements selected from the element group consisting of Co, Ni, Cu and Zn together with Al, and in which the content of the metal elements and the ratio between total Al quantity contained in the magnetic iron oxide and Al quantity present on the surface of the magnetic iron oxide are specified (Japanese Patent Application Laid-Open No. 2002-169328). By using such a magnetic iron oxide, a magnetic toner which is excellent in fluidity, and can provide stable developing performance, and where toner fusion to a photoreceptor hardly occurs in long-term use can be obtained. However, in order to improve phenomena in image quality such as a ghost and scattering, there has been remained room of investigation.

Further, there is a document where, by using a magnetic iron oxide containing one or more elements selected from element group consisting of Mg, Al, Si, P, S, Ca, Cu, and Zn, a hydrocarbon based wax having predetermined values of hydroxyl value and ester value, and styrene-acrylic copolymer resin at the same time, the magnetic iron oxides and the wax are homogeneously dispersed in the toner particles ((Japanese Patent Application Laid-Open No. 2003-122044). In such a toner, degradation or decrease of electrification can be suppressed, and thereby, a magnetic toner enabling stabilized image formation over a long period of durability can be obtained. However, a case where polyester based resin is used as binder resin, has not been considered, and with regard to a case where miniaturizing of toner particles is advanced, there has been room of investigation, yet.

Moreover, a technology is also proposed, where by using a magnetic iron oxide containing one or more elements selected from element group consisting of Al, Si, P, Ti, V, Cr, Mn, Co, Ni, Cu, Zn, Ga, Ge, Zr, Sn, and Pb, and cross-linking polyvinyl resin at the same time, both of the performance of resin and the dispersibility of the magnetic iron oxide are made compatible (Japanese Patent Application Laid-Open No. 2003-221813). In this case, a toner can be obtained, which has stable developing performance and durability, while maintaining the low-temperature fixing property thereof. However, with regard to problems such as tailing when particle size is miniatured, or the like, sufficient investigation has not been done.

Moreover, a magnetic iron oxide has been known, in which magnetite is the main crystal structure thereof and which contains amorphous Al almost homogeneously (Japanese Patent Application Laid-Open No. 2005-170689). Such a magnetic iron oxide is a magnetic material which has a low resistance, a low residual magnetization, a high ratio of FeO, and a good degree of blackness. However, in general, it is required for a toner for electrophotography to have a nearly insulating resistance value, thereby it has been difficult to use such a low resistance magnetic iron oxide.

As mentioned above, in a magnetic iron oxide for magnetic toners, investigation for giving excellent fluidity and environmental stability of charging quantity to the magnetic iron oxide by causing it to contain a different kind of metal has been done, until now, but, under the present situation, there has been room to improve the problems.

DISCLOSURE OF THE INVENTION

An object of the present invention is to provide a magnetic toner where problems as mentioned above have been solved.

In other words, an object of the present invention is to provide a magnetic toner enabling an image with high image density and excellent image reproducibility to be obtained.

Moreover, another object of the present invention is to provide a magnetic toner which is excellent in fluidity, charging stability, and charging uniformity, even for long-term use, and enabling an image whose fogging, ghost, and scattering are suppressed to be obtained.

As a result of repeating energetic research, inventors of the present invention have been found out that a magnetic toner comprising at least a binder resin and a magnetic material, where the magnetic material is a magnetic iron oxide whose dielectric breakdown voltage is 160 to 1600 V/cm and the dielectric loss tangent (tan δ) of the magnetic toner at 100 kHz and 40° C. is $2.0\times10^{-3}$ to $1.0\times10^{-2}$, which, even being used for a long period, can provide an image having high image density, and having no fogging, ghost and scattering, can be obtained.

A magnetic toner, which, even being used for a long period under severe environments such as a high temperature and high humidity environment, and a low temperature and a low humidity environment, can maintain high developing performance and obtain a high-definition image where no problems of images such as fogging, a ghost, and scattering, due to decrease and non-uniformity of charging, is provided.

BEST MODE FOR CARRYING OUT THE INVENTION

The inventors of the present invention, as a result of investigation with regard to the constituting material of a magnetic toner, have found out that the dielectric breakdown voltage of a magnetic material especially composed of a magnetic iron oxide has an intimate relationship with respect to the developing performance of the magnetic toner. Moreover, they have also found out that if the magnetic material is well dispersed in the magnetic toner, the charging adjusting capability as a magnetic toner is sufficiently demonstrated.

In the present invention, a magnetic iron oxide is used as a magnetic material, and the dielectric breakdown voltage thereof is 160 to 1600 V/cm, preferably 400 to 900 V/cm, more preferably 600 to 800 V/cm. When the dielectric breakdown voltage of the magnetic material is within the above range, suppression of leak and suppression of charge up of a triboelectric charging charge can be balanced. Furthermore, since non-uniformity charging of a toner can be suppressed, occurrence of a so-called ghost image, that is a phenomenon when images with a large printing area are developed continuously, intensity of the latter images is reduced, resulting in occurrence of difference in gradation, can be suppressed. Moreover, poor transfer, scattering and fogging after durability test under a high temperature environment can be suppressed.

In other words, in the present invention, since the dielectric breakdown voltage of a magnetic material is 160 to 1600 V/cm, non-uniformity charging and unstable charging due to the leak of triboelectric charging charges on the surface of a magnetic toner can be improved, and excessive charging can be suppressed, thus enabling the amount of charging of the magnetic toner to be maintained at a proper value. As a result, high image density can be maintained without depending on an environment, and phenomena such as a ghost, scattering and fogging, can be suppressed.

The dielectric breakdown voltage of a magnetic material is measured by the following methods according to JIS C 2161.

By weighing 2 g of magnetic material, using a tablet molding press whose inner diameter is 1.3 cm, and applying a pressure of 13720 kPa (140 kg/cm$^2$), a pressed sample whose areas is 1.33 cm$^2$ and thickness is 0.50 to 0.60 cm, is produced. The pressed sample is set on stainless steel electrode plates. At that time, the part between the stainless steel electrodes is completely isolated from outside using a holder made of a fluoro-resin. Using a resistance measuring instrument (made by YOKOGAWA-HEWLETT-PACKARD: 4329A HIGH RESISTANCE METER), by applying a predetermined voltage within a range of 10 V to 1000 V to the set sample, and the resistance R of the pressed sample is measured. Measurement is started from a low applying voltage, and if the applying voltage becomes some higher value, dielectric breakdown occurs, disabling to measure resistance value R. The maximum applied voltage value before the dielectric breakdown occurs is defined as a dielectric breakdown voltage. In addition, measurement is performed under an environment of 23° C. and 50% RH, and the pressed sample is also used after being subjected to temperature/moisture conditioning under the same environment for 24 hours.

The dielectric breakdown voltage of a magnetic material can be controlled by causing the magnetic material to contain a different kind of metal such as Al, Mn and Zn. In particular, by forming a coating layer of a metal oxide or a metal hydrate of metal such as Al, Mn and Zn on the surface of the magnetic material particles, controls over a wide range can be achieved. In order to achieve a very high dielectric breakdown voltage, while maintaining desired magnetic properties, it is most preferable to cause aluminum to be contained in the magnetic material.

It is preferable for the magnetic material to contain 0.5 to 5.0 mass % of Al, more preferably 1.0 to 3.0 mass % of Al, still more preferably, 1.0 to 2.0 mass % of Al. When the Al content is within the above range, it is possible to cover the surface of the magnetic material suitably with Al, and suppression of leak and suppression of charge up of a triboelectric charging charge can be well balanced. Moreover, good fluidity will be obtained.

Moreover, the aluminum dissolution percentage of a magnetic material is given by the following formula:

Al dissolution percentage ($S1$)(%)={(the amount of Al dissolved when the magnetic material is washed in a 1 mol/L aqueous sodium hydroxide solution)/(total Al content in the magnetic material)}×100;

and it is preferably 40 to 60 mass %, more preferably 45 to 60 mass %. When the above Al dissolution percentage (S1) is within the range, in particular, controlling effect of the amount of triboelectric charging increases.

In addition, since the 1 mol/L aqueous sodium hydroxide solution does not penetrate inside the magnetic material, Al dissolved by the solution is only Al existing near the surface of the magnetic material. For the reason, the above Al dissolution percentage (S1) gives the ratio of Al existing near the surface of the magnetic material.

Moreover, it is preferable for the magnetic material to contain Al inside thereof and at the same time to have a coating layer containing Al on the surface thereof. In the case, the coating layer containing Al on the surface of the magnetic material is more densified and the electrical resistance value of the magnetic toner increases, thereby, even under a high temperature and high humidity or low temperature and low humidity environment, the magnetic toner can carry a stable amount of electrifications. Moreover, since such a magnetic material is excellent in fluidity, with regard to the problem of particle aggregation which tends to occur in a small particle size magnetic material, occurrence of the particle aggregation can be suppressed.

Further, with regard to the magnetic material, in a process in which the magnetic material is dissolved in a 1 mol/L aqueous hydrochloric acid solution, Al dissolution percentage (S2) with respect to the total Al content of the magnetic material is preferably 60 to 85 mass % (more preferably 70 to 85 mass %) when the Fe dissolution percentage is 20 mass %, the Al dissolution percentage (S3) with respect to the total Al content of the magnetic material is preferably 80 to 95 mass % (more preferably 90 to 95 mass %) when the Fe dissolution percentage is 60 mass %, and the Al dissolution percentage (S4) with respect to the total Al content of the magnetic material is preferably 95 to 99 mass % when the Fe dissolution percentage is 80 mass %. The aluminum dissolution percentages (S2) to (S4) are given by the following formulas:

Aluminum dissolution percentage (S2) (%)={(the amount of Al dissolved when the Fe dissolution percentage is 20 mass % in the process in which a magnetic material is dissolved in a 1 mol/L chloride of aqueous hydrochloric acid solution)/(total Al content of the magnetic material)}×100;

Aluminum dissolution percentage ($S3$)(%)={(the amount of Al dissolved when the Fe dissolution percentage is 60 mass % in the process in which the magnetic material is dissolved in the 1 mol/L aqueous hydrochloric acid solution)/(total Al content of the magnetic material)}×100;

Aluminum dissolution percentage ($S4$)(%)={(the amount of Al dissolved when the Fe dissolution percentage is 80 mass % in the process in which the magnetic material is dissolved in the 1 mol/L aqueous hydrochloric acid solution)/(total Al content of the magnetic material)}×100.

In addition, the Fe dissolution percentage in the above formulas is given by the following formula:

Fe dissolution percentage (%)={(the amount of Fe dissolved at a certain time of a process in which the magnetic material is dissolved in the 1 mol/L aqueous hydrochloric acid solution)/(total Fe content of the magnetic material)}×100.

"When Fe dissolution percentage is 20 mass %" refers to as a time when 20 mass % of Fe with respect to the total Fe content of a magnetic material is dissolved after the magnetic material is charged in a 1 mol/L aqueous hydrochloric acid solution, dissolution of the magnetic material is started from the surface thereof, and substantially corresponds to a time when 20 mass % of Fe of the magnetic material is dissolved from the surface thereof. And, "Al dissolution percentage (S2) with respect to the total Al content of the magnetic material when the Fe dissolution percentage is 20 mass %" corresponds to the proportion of Al contained in a region of 20 mass % from the surface of the magnetic material.

For the magnetic material, in order to show good electrical properties, in particular to demonstrate sufficient effects when it is used for a small particle magnetic toner, it is preferable to satisfy the above mentioned specifications of the total content, the abundance on the surface of the magnetic material, and the existing state of Al in the magnetic material. Further, in this case, the magnetic properties of the magnetic material are also good. Moreover, when Al is present in such a state described above, thanks to the influence of Al contained inside the magnetic material, the adhesive of a coating layer containing Al with respect to base particles of the magnetic material is improved, thus, resulting in easiness for forming a more densified coating layer.

Moreover, it is preferable for the crystal structure of the magnetic material to be the structure of magnetite. And, it is preferable for Al contained inside the magnetic material, not to be taken into the magnetite crystal but to be present in the magnetite in an amorphous state.

Further it is preferable for the magnetic material to contain, in addition to Al, at least one of metals of group II (Mg, Ca, Sr and Ba), especially Mg. When the group II metals are used, a coating layer can be formed more densely, thus, enabling higher dielectric breakdown voltage within the range specified by the present invention to be obtained.

Although detailed mechanism of this has not been cleared, inventors of the present invention consider that, since $Mg^{2+}$ is coordinated in a crystalline lattice of the magnetite with coordination selectivity; and Mg and Al can form $MgAl_2O_4$ whose crystal structure is the same as that of magnetite, the dense coating layer as mentioned above is formed.

However, by means of X ray diffractometry, the inventors of the present invention confirmed that strong diffraction peaks of magnetite are dominant in the diffraction peaks of the magnetic material used in the present invention, and there is almost no observed diffraction peak originating from base crystal structures. In other words, in the magnetic material, Al components are present as amorphous form compounds.

In addition, the contents of Al and other different elements in the magnetic material are measured by means of qualitative and quantitative analyses of the contained elements based on JIS K 0119 "General Rule of X ray fluorescence analysis", using a Fluorescent X-ray Analysis SYSTEM 3080 (made by Rigaku Industrial Corp.).

Moreover, the crystal structure of the magnetic iron oxide can be analyzed by measuring a lattice constant using an X-ray diffractometer.

Moreover, the Al dissolution percentage and Fe dissolution percentage indicating the distribution of Al in the magnetic material, can be obtained by means of the following methods.

First, about 3 L of deionized water is poured into a 5 L beaker, and heated to 45 to 50° C. in a water bath. 25 g of magnetic material is charged in 400 ml of deionized water to form a slurry, and the slurry is added to a heated 5 L beaker while washing the slurry using 300 ml of deionized water to prepare a magnetic material dispersion.

(1) Washing of a Magnetic Material Using an Aqueous Sodium Hydroxide Solution

When a magnetic material is washed using an aqueous sodium hydroxide solution, deionized water and special grade sodium hydroxide are added to the dispersion so that the concentration of the magnetic material becomes 5 g/L and the concentration of the aqueous sodium hydroxide solution becomes 1 mol/L while keeping the temperature of the magnetic material dispersion in a 5 L beaker at about 50° C. and stirring the dispersion at 200 rpm. After that, the dissolution of metals other than Fe on the surface of the magnetic material particles is started. After being left to stand for 30 min., the dissolution liquid is filtered through a 0.1 μm membrane filter, and 20 mL of a filtrate is collected. Then, using a plasma emission spectrometry (ICP) measuring apparatus, Al concentration of the collected filtrate is quantitatively determined.

(2) Dissolution of a Magnetic Material Using an Aqueous Hydrochloric Acid Solution When a magnetic material is dissolved in an acid, deionized water and special grade hydrochloric acid are added to the magnetic material dispersion in a 5 L beaker so that the concentration of the magnetic material is 5 g/L and the concentration of the aqueous hydrochloric acid solution is 1 mol/L (when the entire amount of the magnetic material is dissolved, a mixed acid may be added, and it may be used at a concentration of about 3 mol/L), while keeping a temperature at about 50° C. and stirring at 200 rpm to start dissolution.

Until the entire magnetic material is dissolved and the dissolution solution becomes clear, the dissolution solution is collected every 10 minutes and the dissolution solution is filtered through a 0.1 μm membrane filter, and about 20 ml of filtrate is collected. Then, using a plasma emission spectroscopy (ICP) measuring apparatus, the concentrations of Al and Fe in the collected filtrates are quantitatively determined.

The obtained results show that an Al dissolution percentage curve with respect to Fe dissolution percentage is obtained by calculating Al dissolution percentages and Fe dissolution percentages in samples collected every 10 minutes, plotting Al dissolution percentages with respect to Fe dissolution percentages, and smoothly connecting them.

In addition, an Al dissolution percentage (S1) can be calculated from an Al concentration when the magnetic material is washed using an aqueous sodium hydroxide solution and an Al concentration when the magnetic material is perfectly dissolved using an aqueous hydrochloric acid solution. Moreover, Al dissolution percentages (S2) to (S4) can be obtained from the Al dissolution percentage curve with respect to Fe dissolution percentage.

The isoelectric point of the magnetic material is preferably equal to or greater than pH 7.0 and equal to or smaller than 10.0, more preferably, equal to or greater than pH 8.0 and equal to or smaller than 10.0, and still preferably equal to or greater than pH 9.0 and equal to or smaller than 10.0. In addition, the isoelectric point of magnetite is an order of pH 6.5. In general, the isoelectric point is influenced by added amount of a different kind of element and an existing state on the surface of the magnetic material of the different kind of element. When the isoelectric point is within the above range, it can be considered that the surface of the magnetic material is sufficiently coated with Al, thereby, good fluidity can be obtained. And as a magnetic toner, a nearly uniformly charging characteristic can be achieved, thus enabling a ghost and reduction of image density to be suppressed.

The isoelectric point of the magnetic material is measured by means of the following method.

First, the magnetic material is dispersed in an ion-exchanged water at 25° C. to prepare a dispersion having a sample concentration of 1.8 mass %. A zeta potential is measured using Ultrasonic type Zeta potential measuring apparatus DT-1200 (made by Dispersion Technology Inc.) and by titrating the dispersions using the 1 mol/L of an aqueous hydrochloric acid solution or an aqueous sodium hydroxide solution. The pH when the zeta potential is 0 mV is defined as an isoelectric point.

Moreover, the volume resistance of the magnetic material measured under an environment of 23° C. and 50% RH is preferably $1\times10^7$ to $1\times10^9$ Ω·cm. In general, if a different kind of metal is contained in the magnetic material, the volume resistance of the magnetic material tends to decrease, but it is preferable for the magnetic material to have a relatively higher volume resistance within the above range, in a viewpoint that a toner can surely hold charges.

The volume resistance of the magnetic material as mentioned above can be adjusted using the content of a different kind of metal such as Al and the coating volume, and the volume resistance can also be adjusted by densifying the coating layer of a different kind of metal. In special, it is preferable to use group II metals (Mg, Ca, Sr and Ba), and it is more preferable to use Mg especially. By using a different kind of metal such as Mg, the final Al coating layer can be formed more densely.

Moreover, it is preferable for the magnetic material to be configured with spherical particles mainly formed by a curved plane with no plate-like plane and to be a magnetic material containing few octahedral particles.

Moreover, it is preferable for the number-average particle diameter (D1) of the magnetic material to be 0.08 to 0.25 μm from viewpoints of dispersibility in a binder resin, degree of blackness, and magnetic properties of the magnetic material.

The number-average particle diameter of the magnetic material is measured by means of the following method. Using a transmission electron microscope picture (magnification: 30,000), by selecting 100 pieces of particles on the picture at random, measuring the maximum length of each particle, the arithmetical mean value thereof is defined as the number-average particle diameter of the magnetic material.

A magnetic material is preferably used, whose magnetic properties under 795.8 kA/m (10 kOersted) magnetic field are as follows: $\sigma_{10k}$: 10 to 200 A $m^2$/kg (more preferably 70 to 90 A m/kg); residual magnetization or: 1 to 100 A $m^2$/kg (more preferably 2 to 20 A $m^2$/kg); and coercive force Hc is 1 to 30 kA/m (more preferably 2 to 15 kA/m). Having such magnetic properties, the magnetic material can have good developing performance as a magnetic toner. The magnetic properties of the magnetic material are measured under 795.8 kA/m of external magnetic field, using a "vibrating sample magnetometer VSM-3S-15" (made by TOEI INDUSTRY CO. LTD.).

Hereinafter, a specific material used for a magnetic material and the manufacturing method thereof will be described. In the following description, in a magnetic material with a coating layer, a part inner than the coating layer is referred to as a base magnetic material, and the base magnetic material coated with the coating layer is referred to as a magnetic material.

As a magnetic material, any one of magnetic iron oxides such as magnetite, maghemite, and ferrite, or a mixture thereof, which contain a different kind of element, can be used, but, preferably, a magnetic material consisting primarily of magnetite whose FeO content is rich, can be used. In general, magnetite particles are obtained by oxidizing a ferrous hydroxide slurry obtained by neutralizing and mixing a ferrous salt aqueous solution and an alkaline aqueous solution.

Moreover, as one method for obtaining a magnetic material which has a dielectric breakdown voltage specified in the present invention, there is a method of controlling an existing state of Al in the magnetic material. For example, in the manufacture process of the base magnetic material, a method where a lot of Al exists on the surface of the base magnetic material, and an Al containing coating layer is provided on the surface of the base magnetic material, is included. By making a lot of Al to be contained on the surface of the base magnetic material, adhesion between the surface of the base magnetic material and the coating layer can be increased, and a dense coating layer can be formed.

Specifically, to ferrous sulfate aqueous solution, by adding an Al component at an amount corresponding to 4000-6000 ppm with respect to an iron component, and alkali such as sodium hydroxide and potassium hydroxide, at an amount equal to or greater than the equivalent weight with respect to the iron component, a ferrous hydroxide aqueous solution is prepared. At that time, it is preferable to add further a predetermined amount and one or more kinds of metal salts selected from the group II metal elements (Mg, Ca, Sr and Ba). While maintaining pH of the prepared ferrous hydroxide solution to be equal to or greater than 7 (preferably, pH: 8 to 10, and when a group II metal element is added, pH: 11 or more), blowing air in the aqueous solution, and heating the solution at a temperature equal to or greater than 70° C., oxidation reaction is performed, resulting in generation of a base magnetic material particle to be a core of the magnetic material particle.

Next, the Al component at an amount corresponding to 4000 to 6000 ppm is added in a slurry-like liquid containing the base magnetic material, the liquid is stirred at 75 to 85° C., pH of the liquid is adjusted to 11 or more, subsequently, an aqueous solution containing salts of one or more metals selected from the group II metal elements (Mg, Ca, Sr and Ba) at an amount of 100 to 2000 ppm with respect to the entire magnetic material is added to the liquid, and the slurry is mixed for at least 10 minutes or more. After that, by adding an acidic aqueous solution, pH is adjusted to 8 to 10 once, the slurry is stirred for 5 minutes or more, and, pH is gradually reduced and finally set to 6.5 to 7.5 by adding an acidic aqueous solution again. Then, by washing, filtering and subsequently drying the slurry, magnetic material particles are obtained. Further, in order to adjust an average particle size, smoothness, and specific surface area to be within preferable ranges, using a mix muller or an automated mortar, the particles may be subjected to compaction, shearing, and squeezing with a spatula.

As the Al components used in order to introduce Al into the magnetic material, aluminum sulfate, sodium aluminate, an aluminum chloride, and an aluminum nitrate are included.

Moreover, as ferrous salts, iron sulfate which is a by-product in common manufacturing of titanium by a sulfuric acid method, and iron sulfate which is a by-product accompanied with surface washing of a steel plate can be used, and also, iron chloride, etc. can be used.

Moreover, it is preferable for the magnetic material to have a few total content of P, S, Cr, Mn, Co, Ni, Cu, and Zn. Although these elements are often contained as unavoidable components originating from raw materials when the magnetic iron oxide is manufactured, it is preferable for the total content of the components to be low, that is, equal to or smaller than 1 mass % considering a degree of blackness and magnetic properties.

Moreover, in the magnetic toner, it is preferable for the magnetic material to be contained at an amount of 50 to 150 mass %, more preferably 60 to 120 mass %, with respect to 100 mass % of binder resin. When the content of the magnetic material is within the above range, occurrence of fogging and scattering can be suppressed, and a sufficient coloring power can be obtained. Moreover, flying from a toner bearing member can also be performed without problem.

Moreover, the dielectric loss tangent (tan δ) of a magnetic toner of the present invention measured in a frequency of 100 kHz and at 40° C. is $2.0\times10^{-3}$ to $1.0\times10^{-2}$. The value of the dielectric loss tangent in the magnetic toner can be used as an index of the dispersion state of the magnetic material. And, since the dispersion state of the magnetic material influences the charge retention power of a toner, it can also be considered as an index of the charge retention power of a toner. In the magnetic toner, when the dielectric loss tangent is within the above range, the dispersion state of the magnetic material is in a proper state, and balancing between retention and discharge of electric charges will be in a suitable state.

The dispersion state of the magnetic material in the toner can be controlled by, melting and kneading conditions such as a temperature and a mixing state, and by adjusting the amount, the particle size and the particle size distribution of the magnetic material. Moreover, it can also be controlled by subjecting the magnetic material after synthesized to mechanical processing so that the magnetic cohesiveness is suppressed and the surface of the magnetic material is modified.

The dielectric loss tangent of the magnetic toner is measured by the following method.

Using a 4284A precision LCR meter (made by Hewlett Packard Co.) calibrated in the frequency of 1 kHz and 1 MHz, a dielectric constant is measured and a dielectric loss tangent is calculated from the measured value.

Specifically, 1 g of magnetic toner is taken, a load of 19600 kPa (200 kg/$cm^2$) is applied for molding for 2 minutes to obtain, a disk-like measurement sample 25 mm in diameter and 1 mm or less (preferably 0.5 to 0.9 mm) in thickness. The measurement sample is set to ARES (made by Rheometric Scientific, Inc.) equipped with a dielectric constant measuring tool (electrode) whose diameter is 25 mm, and heated to be fixed. In this state, the magnetic material is fixed at lower temperature so that the dispersion state of the magnetic material in the toner is not changed. In the later working examples, the fixation is carried out at 80° C. After that, the toner is cooled to a temperature of 40° C. and the dielectric constant of the toner in 100 kHz is measured, in a frequency range of 500 to $5\times10^5$ Hz while applying a load of 1.47 N (150 g) to the toner using a 4284A precision LCR meter (made by Hewlett Packard Co.). Here, a frequency of 100 kHz is used as the standard of measuring a dielectric loss tangent (tan δ) because the frequency is suitable for examining the dispersion state of the magnetic material.

The magnetic toner of the present invention contains at least a binder resin besides the magnetic material. As the binder resin, various kinds of resin compound conventionally known as a binder resin can be used. For example, a vinyl resin, a phenolic resin, a natural resin-modified phenolic resin, a natural resin-modified maleic acid resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a cumarone-indene resin, and a petroleum resin are included.

In particular, the binder resin is preferably a resin having at least a polyester unit. The resin having the polyester unit is the polyester resin itself and a hybrid resin where the polyester resin and the vinyl resin are chemically combined.

Since the resin having a polyester unit obtained from an acid component and an alcohol component has a lot of easter bonds, affinity to Al on the surface of the magnetic material becomes high, and mixing performance with the magnetic material becomes excellent, thus resulting in that desorption of the magnetic material hardly occurs when a magnetic material containing Al is used.

Moreover, in the polyester unit portion of the resin having a polyester unit, it is preferable that 45 to 55 mol % in all components is an alcohol component and 55 to 45 mol % is an acid component.

As the alcohol components, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexane diol, bisphenol A hydride, bisphenol derivatives represented by the following formula (B), diols represented by the following formula (C), and polyhydric alcohols such as glycerin, sorbitol and sorbitan are included.

(B)

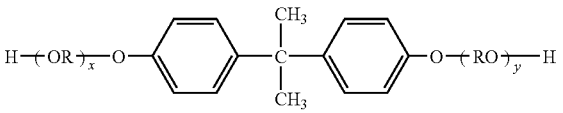

wherein R represents an ethylene group or a propylene group, x and y represents integers equal to or greater than 1, respectively, and the average value of (x+y) is 2 to 10.

(C)

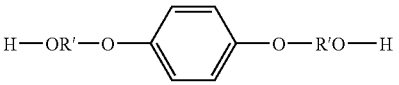

wherein R' represents —$CH_2CH_2$—, —$CH_2$—$CH(CH_3)$— or —$CH_2$—$C(CH_3)_2$—.

As trivalent or higher polyhydric alcohol components, sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzen are included. As particularly preferred trivalent or higher polyhydric alcohol components, oxyalkyleneether of novolac-type phenolic resin represented by the following formula (D) are included.

(D)

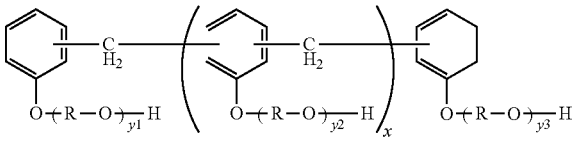

wherein R represents ethylene group or propylene group, x is an integer of 0 or more, y1 to y3 are the same or different integers of 0 or more provided that when x is 2 or more each y2 may be the same or different value.

Moreover, as an example of acid component, carboxylic acid can be preferably included. As divalent carboxylic acids: benzene dicarboxylic acids or anhydrides thereof, such as phthalic acid, terephthalic acid, isophthalic acid, and phthalic anhydride; alkyl dicarboxylic acids or anhydrides thereof, such as succinic acid, adipic acid, sebacic acid, and azelaic acid; and unsaturated dicarboxylic acid or anhydrides thereof, such as fumaric acid, maleic acid, citraconic acid, and itaconic acid are included. And as trivalent or higher carboxylic acids, trimellitic acid, pyromellitic acid, benzophenonetetracarboxylic acid, and anhydrides thereof are included.

As especially preferable alcohol components of the polyester unit, bisphenol derivatives represented by the above formula (B) are included, and as especially preferable acid components: phthalic acid, terephthalic acid, isophthalic acid or anhydride thereof, succinic acid, n-dodecenylsuccinic acid or the anhydride thereof, dicarboxylic acids such as fumaric acid, maleic acid, and a maleic anhydride, and tricarboxylic acids such as trimellitic acid or the anhydride thereof, are included. A magnetic toner using a resin including a polyester unit obtained from these acid components and alcohol components as the binder resin thereof has good dispersion of the magnetic material, excellent developing performance, good fixing property, and excellent offset resistance.

As a binder resin, as mentioned above, a hybrid resin where a polyester unit and a vinyl resin unit are chemically combined, may be used, and at that time, as a resin constituting the vinyl resin unit, vinyl resins as follows can be used. In addition, the following vinyl resins may be used alone, and they may be used by blending with other resins.

As the vinyl resin, polymers using vinyl monomer, for example, styrene; styrene derivatives such as o-methyl styrene, m-methyl styrene, p-methylene styrene, p-methoxy styrene, p-phenyl styrene, p-chloro styrene, 3,4-dichloro styrene, p-ethyl styrene, 2,4-dimethyl styrene, p-n-butyl styrene, p-tert-butyl styrene, p-n-hexyl styrene, p-n-octyl styrene, p-n-nonyl styrene p-n-decyl styrene, and p-n-dodecyl styrene; ethylenic unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate and vinyl benzonate; α-methylenic aliphatic monocarboxylate esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, diethylaminoethyl methacrylate, and dimethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole, and an N-vinylpyrrolidone; vinylnaphthalenes; acrylic acid derivatives or methacrylic acid derivatives such as acrylonitrile, methacrylonitrile and acryl amide; esters of α,β-unsaturated acid; diesters of dibasic acid; acrylic acid such as acrylic acid, methacrylic acid, α-ethylacrylic acid, crotonic acid, cinnamic acid, vinyl acetic acid, isocrotonic acid, and angelic acid and the α- or β-alkyl derivatives thereof; unsaturated dicarboxylic acid such as fumaric acid, maleic acid, citraconic acid, alkenylsuccinic acid, itaconic acid, mesaconic acid, dimethylmaleic acid, and dimethylfumaric acid, and monoester derivatives thereof or anhydrides thereof are included. In the vinyl resin, one or two or more vinyl monomers as mentioned above are used. Among these, combinations of monomers providing a styrene copolymer or a styrene-acrylic copolymer are preferable. Among these, combinations of monomers providing a styrene-type copolymer or a styrene-acrylic copolymer are preferable.

A method of synthesizing a binder resin composed of vinyl homopolymer or copolymer, is not limited in particular, various kinds of manufacturing methods known from the former can be used, for example, polymerizing methods such as a bulk polymerization method, a solution polymerization method, a suspension polymerization method, and an emulsion polymerization method, can be used. When a carboxylic acid monomer or an acid anhydride monomer is selected, it is preferable to use the bulk polymerization method or the solution polymerization method in view of properties of the monomer.

Moreover, the binder resin used for the present invention may be a polymer or a copolymer cross-linked by cross-linkable monomers such as those exemplified below, if needed. As the cross-linkable monomer, a monomer having two or more cross-linkable unsaturated bonds can be used.

As the cross-linkable monomer, aromatic divinyl compounds, such as divinylbenezene and divinylnaphthalene; diacrylate compounds bonded by an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and above-mentioned compounds in which acrylate is replaced by methacrylate; diacrylate compounds bonded by an alkyl chain including an ether bond, such as diethyl glycol diacrylate, triethylene glycol diacrylate, tetraethylene glycol diacrylate, polyethylene glycol #400 diacrylate, polyethylene glycol #600 diacrylate, dipropylene glycol diacrylate, and above-mentioned compounds in which acrylate is replaced by methacrylate; diacrylate compounds bonded by a chain including an aromatic group and an ether bond, such as polyoxyethylene (2)-2,2-bis(4-hydroxyphenyl)propane diacrylate, polyoxyethylene (4)-2,2-bis(4-hydroxyphenyl)propane diacrylate, and above-mentioned compounds in which acrylate is replaced by methacrylate; and polyester-type diacrylate compounds, such as MANDA (trade name), Nippon Kayaku Co., are included.

As polyfunctional cross-linking agents, pentaerythritol triacrylate, trimethylolethane triacrylate, trimethylolpropane triacrylate, tetramethylolmethane tetraacrylate, oligoester acrylate, and above-mentioned compounds in which acrylate is replaced by methacrylate; triallyl cyanurate, and triallyl trimellitate, are included.

Among the cross-linkable monomers, as a cross-linkable monomer preferably used for a binder resin, from view points of the fixing property and offset resistance of the obtained magnetic toner, aromatic divinyl compound (especially, divinylbenzene) and diacrylate compounds linked with a chain including an aromatic group and an ether bond, are included.

Moreover, it is preferable for the amount of the cross-linking agent to be adjusted according to the type of monomers to be cross-linked, physical properties required to a binder resin, and, in general, the cross-linking agent can be used in an amount of 0.01 to 10 parts by mass (more preferably 0.03 to 5 parts by mass), with respect to 100 parts by mass of other monomer components constituting the binder resin.

Moreover, materials other than mentioned above, such as a homopolymer or a copolymer of vinyl monomers, polyester, polyurethane, an epoxy resin, polyvinyl butyral, rosin, modified rosin, a terpene resin, a phenolic resin, an aliphatic or alicyclic hydrocarbon resin, and an aromatic petroleum resin can be used by mixing in the binder resin mentioned above, if needed. When two or more resins are mixed and used as the binder resin, it is more preferable to mix resins with different molecular weight in a suitable ratio.

Moreover, the glass transition temperature of the binder resin is preferably 45 to 80° C., more preferably 55 to 70° C. Moreover, the number-average molecular weight (Mn) of the binder resin is preferably 2,500 to 50,000 and the weight-average molecular weight (Mw) of the binder resin is preferably 10,000 to 1,000,000.

The glass transition temperature of the binder resin, as a theoretical glass transition temperature described in publication POLYMER HANDBOOK, 2nd Edition, III pp. 139-192 (John Wiley & Sons, Inc.), may range from 45 to 80° C. and can be adjusted by selecting the constituent (polymerizable monomer) of the binder resin. Moreover, the glass transition temperature of the binder resin can be measured according to ASTM D3418-82 using a differential scanning calorimeter, for example, DSC-7 made by Perkin-Elmer Corporation, or DSC2920 made by TA Instruments. Japan Inc. If the glass transition temperature of the binder resin is within the above-mentioned range, good balancing of preservation stability and fixing property of the binder resin can be achieved.

As wax, the following materials are exemplified. For example, aliphatic hydrocarbon wax such as low-molecular weight polyethylene, low-molecular weight polypropylene, a polyolefin copolymer, polyolefin wax, microcrystalline wax, paraffin wax, and Fischer-Tropsch wax; oxides of aliphatic hydrocarbon wax such as oxidized polyethylene wax, or the block copolymers thereof; vegetable wax such as candelilla wax, carnauba wax, Japan wax and jojoba wax; animal wax such as bee wax, lanoline and whale wax; mineral wax such as ozokerite, ceresine and petrolatum; wax principally constituted of aliphatic esters such as montan ester wax and castor wax; and totally or partially deacidified aliphatic esters such as deacidified carnauba wax, are included. Further, saturated linear aliphatic acids such as palmitic acid, stearic acid and montanic acid or long-chain alkyl carboxylic acids having an longer alkyl chain; unsaturated aliphatic acids such as brassidic acid, eleostearic acid and parinaric acid; saturated alcohols such as stearyl alcohol, eicosyl alcohol, behenyl alcohol, carnaubyl alcohol, ceryl alcohol, and melissyl alcohol, or alkyl alcohol having an longer alkyl chain; polyhydric alcohols such as sorbitol; aliphatic amides such as linoleamide, oleylamide and laurylamide; saturated aliphatic bisamides such as methylbisstearylamide, ethylenebiscaprylamide, ethylenebislaurylamide and hexamethylenebisstearylamide; unsaturated aliphatic acid amides such as ethylenebisoleylamide, hexamethyelenbisoleylamide, N,N'-dioleyladipylamide and N,N'-dioleylsebacylamide; aromatic bisamides such as m-xylenebisstearylamide and N,N'-distearylisophthalylamide; aliphatic metal salts (so-called metal soap) such as calcium stearate, calcium laurate, zinc stearate and magnesium stearate; wax formed by grafting vinyl monomers such as styrene and acrylic acid to aliphatic hydrocarbon wax; partial esters of aliphatic acid and a polyhydric alcohol such as behenic acid monoglyceride; and methyl ester compounds having a hydroxyl group obtained by hydrogenating vegetable fats and oils, are included.

Further, the magnetic toner may contain wax.

As wax, the following materials are exemplified. For example, aliphatic hydrocarbon wax such as low-molecular weight polyethylene, low-molecular weight polypropylene, a polyolefin copolymer, polyolefin wax, microcrystalline wax, paraffin wax, and Fischer-Tropsch wax; oxides of alipohatic hydrocarbon wax such as oxidized polyethylene wax, or the block copolymers thereof; vegetable wax such as candelilla wax, carnauba wax, Japan wax and jojoba wax; animal wax such as bee wax, lanoline and whale wax; mineral wax such as ozokerite, ceresine and petrolatum; wax principally constituted of aliphatic esters such as montan ester wax and castor wax; and totally or partially deacidified aliphatic esters such as deacidified carnauba wax, are included. Further, saturated linear aliphatic acids such as palmitic acid, stearic acid and montanic acid or long-chain alkyl carboxylic acids having an longer alkyl chain; unsaturated aliphatic acids such as brassidic acid, eleostearic acid and parinaric acid; saturated alcohols such as stearyl alcohol, eicosyl alcohol, behenyl alcohol, carnaubyl alcohol, ceryl alcohol, and melissyl alcohol, or alkyl alcohol having an longer alkyl chain; polyhydric alcohols such as sorbitol; aliphatic amides such as linolamide, oleylamide and laurylamide; saturated aliphatic bisamides such as methylbisstearylamide, ethylenebiscaprylamide, ethylenebislaurylamide and hexamethylenebisstearylamide; unsaturated aliphatic acid amides such as ethylenebisoleylamide, hexamethyelenbisoleylamide, N,N'-dioleyladipylamide and N,N'-dioleylsebacylamide; aromatic bisamides such as m-xylenebisstearylamide and N,N'-distearylisophthalylamide; aliphatic metal salts (so-called metal soap) such as calcium stearate, calcium laurate, zinc stearate and magnesium stearate; wax formed by grafting vinyl monomers such as styrene and acrylic acid to aliphatic hydrocarbon wax; partial esters of aliphatic acid and a polyhydric alcohol such as behenic acid monoglyceride; and methyl ester compounds having a hydroxyl group obtained by hydrogenating vegetable fats and oils, are included.

Moreover, above-mentioned wax whose molecular weight distribution is sharped using a pressing-sweating process, a solvent method, a recrystallization method, a vacuum distillation method, a supercritical gas extraction method, or a melt-crystallization method, and above-mentioned wax whose low molecular weight solid fatty acid, low molecular weight solid alcohol, low molecular weight solid compound, and other impurities are removed are also preferably used.

Wax whose meting point is 60 to 120° C., more preferably 70 to 110° C. is preferable. By using wax whose melting point is within the above range, the dispersibility in the binder resin of the magnetic material can be improved.

Moreover, it is preferable to add a charge control agent to a toner, and well-known various types of charge control agents can be used. As negative charge control agents, a metal complex of mono azo dye described, for example, in Japanese Patent Publication Nos. S41-020153, S42-027596, S44-006397, and S45-026478; nitrohumic and the salt thereof or pigment/dye such as C. I. 14645 described in Japanese Patent Application Laid-Open No. S50-133838; Zn, Co, Cr, Fe, and Zr metal compound of salicylic acid naphthoic acid and dicarboxylic acid described in Japanese Patent Publication Nos. S55-042752, S58-041508, S58-007384, and S59-007385; sulfonated phthalocyanine pigment; styrene oligomer in which a nitro group and halogen is introduced; and chlorinated paraffin, can be included. In particular, azo metal complex represented by the following general formula (I), and basic organic metal complex represented by the following general formula (II), which is excellent in dispersibility inside a magnetic toner, and has an effect in stability of image density and reduction of fogging, are preferable.

(I)

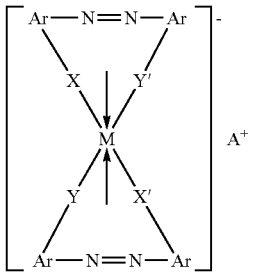

wherein M represents a coordination center metal such as Cr, Co, Ni, Mn, Fe, Ti, or Al. Ar represents an aryl group, such as a phenyl group and a naphthyl group, and may have a substituent. As the substituent in this case, there are a nitro group, a halogen group, a carboxyl group, an anilide group, an alkyl group having 1 to 18 carbon atoms, and an alkoxy group having 1 to 18 carbon atoms. X, X', Y, and Y' represent —O—, —CO—, —NH—, and —NR— (R is an alkyl group having 1 to 4 carbon atoms), respectively. $A^+$ represents a hydrogen ion, a sodium ion, a potassium ion, an ammonium ion, or an aliphatic ammonium ion, or the mixed ions thereof.

(II)

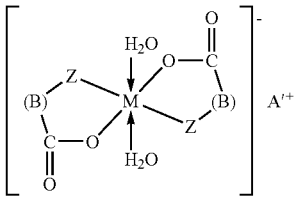

wherein M represents a coordination center metal such as Cr, Co, Ni, Mn, Fe, Ti, Zr, Zn, Si, B, or Al. (B) represents aromatic series compounds which may have an alkyl group, a halogen atom, and a nitro group as a substituent, for example, phenylene and naphtalene.

$A'^+$ represents a hydrogen ion, a sodium ion, a potassium ion, an ammonium ion, an aliphatic ammonium ion, or the mixed ions thereof.

Z represents —O— or —COO—.

Among these, the azo metal complex represented by the above formula (I) is more preferable, and especially, an azo iron complex whose central metal is Fe is, most preferable.

The charge control agents can be used alone or in combination of two or more kinds of those. The amount of the charge control agent used is preferably 0.1 to 5.0 parts by mass with respect to 100 parts by mass of the binder resin from viewpoint of the amount of charge of the magnetic toner.

Among the negative charge control agents as mentioned-above, for example, SPILON BLACK TRH, T-77, and T-95 (Hodogaya Chemical Industries Co., Ltd.), and BONTRON (registered trademark) S-34, S-44, S-54, E-84, E-88, and E-89 (Orient Chemical) are preferable for commercially available products.

On the contrary, as the substances controlling a toner to have a positive charge, the following materials are included. They are nigrosin and modified nigrosins of its aliphatic metal salts; quaternary ammonium salts such as tributyl-benzylammonium-1-hydroxy-4-naphtosulfonate salt and tetra-butylammonium tetrafluoro borate, and onium salts such as their phosphonium salts that are analogs of those compounds and the lake pigments there of triphenymethane dyes and the lake pigments thereof (laking agents: phosphorus tungstic acid, phosphorus molybdenic acid, phosphorus tungsten molybdenic acid, tannic acid, lauric acid, gallic acid, ferricyanide, ferrocyanide); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate, which can be used alone or in combination thereof.

Among the positive charge control agents as mentioned-above, for example, TP-302 and TP-415 (Hodogaya Chemical Industries Co., Ltd.), BONTRON(registered trademark) N-01, N-04, N-07 and P-51 (Orient Chemical), and Copy Blue PR(Clariant Japan) are preferable for commercially available products.

Moreover, it is preferable to add inorganic fine powder externally on the surface of a toner base particle as an external additive, and it is preferable to use the inorganic fine powder after hydrophobizing it. For example, as the inorganic fine powder, silica fine powder can be used.

With regard to silica fine powder, both of dry silica which is manufactured from so-called dry process silica or fumed silica produced by vapor-phase oxidation of a silicon-halogen compound, and so-called wet silica which is manufactured from water glass can be used, but the dry silica which has a few silanol groups on the surface and inside thereof and few manufacture residue is more preferable.

When the silica fine powder is subjected to a hydrophobizing treatment, as a method of hydrophobizing the silica fine powder, a method of chemically treating silica fine powder using an organic silicon compounds which react with the silica fine powder or physically adsorb to the silica fine powder are included. As a preferable method, a method in which after or at the same time when being treated with a silane compound, dry silica fine powder which is produced by means of vapor phase oxidation of a silicon halogen compound is chemically treated with an organic silicon compound such as silicone oil is included.

As the silane compounds used for the hydrophobizing treatment, for example, hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethylethoxy silane, dimethyldimethoxy silane, diphenyldiethoxy silane, hexamethyl disiloxane, 1,3-divinyl tetramethyl disiloxane, and 1,3-diphenyl tetramethyl disiloxane are included.

As the organic silicon compound, silicone oil is included. As preferable silicone oils, silicone oil whose viscosity at 25° C. is about $3\times10^{-5}$ to $1\times10^{-3}$ $m^2/s$ is used and for example, dimethyl silicone oil, methyl hydrogen silicone oil, methylphenyl silicone oil, α-methyl styrene-modified silicone oil, chlorophenyl silicone oil, fluorine-modified silicone oil are preferable.

Inorganic fine powder is desirable used in 0.1 to 5 parts by mass (preferably 0.1 to 3 parts by mass) with respect to 100 parts by mass of the magnetic toner base particle.

If required, external additives other than silica fine powder may be added to a toner. The additives are, for example, resin fine particles and inorganic fine particles acting as an electrification auxiliary agent, an electrical-conductivity-providing agent, a fluidity-providing agent, an anti-caking agent, lubricant, and abrasive. Specifically, as lubricants, polyfluoroethylene, zinc stearate and polyvinylidene fluoride are included, and, among these, polyvinylidene fluoride is preferable. Or, as abrasives, cerium oxide, silicon carbide and strontium titanate are included, and among these, strontium titanate is preferable. Or, as fluidity-providing agents, titanium oxide and aluminum oxide are included, and among these, hydrophobic one is preferable. Among others, anti-caking agents; electrical-conductivity-providing agents such as carbon black, zinc oxide and antimony oxide and tin oxide; and developing performance improvers such as white fine particles and black fine particles having opposite polarity, can be used in a small quantity. The weight-average particle diameter (D4) of the toner is preferably 4.0 to 9.0 μm, more preferably 5.0 to 8.0 μm. When the weight-average particle diameter is within the above range, good balancing of developing performance and fine line reproducibility can be achieved.

In addition, the weight-average particle diameter of a toner is measured by using a Coulter counter TA-II or Coulter Multisizer (made by Beckman Coulter, Inc.) As an electrolytic solution, a 1% aqueous NaCl solution is prepared by using a reagent-grade sodium chloride. For example, ISOTON R-II (made by Beckman Coulter, Inc.) can be used. In the measuring method thereof, 0.1 to 5 ml of a surfactant is added into 100 to 150 ml of the electrolytic solution as a dispersant, and 2 to 20 mg of a measurement sample was added thereto. The electrolytic liquid in which the sample was suspended was subjected to a dispersion treatment for about 1 to 3 minutes using an ultrasonic disperser, the volume and number of a toner whose particle size was equal to or greater than 2 μm were measured, by the measuring apparatus and using a 100 μm aperture as an aperture, the volume distribution and number distribution of the sample were calculated, and a weight-average particle diameter (D4) was obtained from the results.

The method of manufacturing a magnetic toner of the present invention is not limited in particular, but it is preferable to use a pulverization process. In the method, materials such as binder resins, a magnetic material, and if required, wax is mixed thoroughly, by a mixing machine such as a Henschel mixer or a ball mill, and then the mixture obtained is molten and kneaded by a heat kneading machine such as a roller, a kneader and an extruder, resulting in a state where the magnetic material is dispersed in mutually dissolved resins. Then, after cooling and solidifying the mixture, pulverizing and classifying the solidified mixture, base magnetic toner particles can be obtained. Then, if required, silica fine powder and/or other external additives are externally added and mixed with the obtained base magnetic toner particles.

In a kneading step, although the magnetic material is sometimes oxidized due to rising of the kneading temperature, and thereby the color of the magnetic toner takes on a red tinges, the phenomenon can be suppressed when a magnetic material whose surface is densely coated with Al. Moreover, by using wax whose melting point is lower, the kneading temperature can be reduced, and the oxidation of the magnetic material particles can be suppressed, thus enabling that the magnetic toner takes on a red tinges to be suppressed.

As the mixing machine used for manufacturing a magnetic toner, for example, Henschel Mixer (made by Mitsui Mining & Smelting Co., Ltd.); Super Mixer (made by Kawata K.K.); Ribocone (made by Ohkawara Seisakusho K.K.); Nauta Mixer, Turbulizer and Cyclomix (made by Hosokawa Micron Corporation); Spiral Pin Mixer (made by Taiheiyo Kiko K.K.); and Loedige Mixer (made by Matsubo K.K.) are included. As the kneading machines, KRC Kneader (made by Kurimoto Tekkosho K.K.); Buss-Kneader (made by Buss Co.); TEM-type Extruder (made by Toshiba Machine Co., Ltd.); TEX Twin-screw Extruder (made by Nippon Seiko K.K.); PCM Kneader (made by Ikegai Tekkosho K.K.); Three-Roll Mill, Mixing Roll Mill, and Kneader (made by Inoue Seisakusho K.K.); Kneadex (made by Mitsui Mining & Smelting Co., Ltd.); MS-type Pressure Kneader, Kneader-Ruder (made by Moriyama Seisakusho K.K.); and Banbury Mixer (made by Kobe Seikosho K.K.), are included. As the pulverizing machines, Counter Jet Mill, Micron Jet and Inomizer (made by Hosokawa Micron Corporation); IDS-type Mill and PJM Jet Grinding Mill (made by Nippon Pneumatic Kogyo K.K.); Cross Jet Mill (made by Kurimoto Tekkosho K.K.); Ulmax (made by Nisso Engineering K.K.); SK Jet O-Mill (made by Seishin Kigyo K.K.); Criptron (made by Kawasaki Heavy Industries, Ltd.); and Turbo Mill (made by Turbo Kogyo K.K.), and Super Rotor (made by Nisshin Engineering K.K.), are included. As the classifiers, Classyl, Micron Classifier and Spedic Classifier (made by Seishin Kigyo K.K.); Turbo Classifier (made by Nisshin Engineering K.K.); Micron Separator, Turboprex(ATP) and TSP Separator (made by Hosokawa Micron Corporation); Elbow Jet (made by Nittetsu Mining CO., Ltd.); Dispersion Separator (made by Nippon Pneumatic Kogyo K.K.); and YM Microcut (made by Yasukawa Shoji K.K.), are included. As the sifters used to sieve coarse powder, Ultrasonics (made by Koei Sangyo K.K.); Rezona Sieve and Gyro Sifter (made by Tokuju Kosakusho K.K.); Vibrasonic Sifter (made by Dulton Co.); Sonicreen (made by Shinto Kogyo K.K.); Turbo-Screener (made by Turbo Kogyo K.K.); Microsifter (made by Makino mfg. CO., Ltd.); and circular vibrating screens, are included.

EXAMPLES

Hereinafter, referring to Examples, the present invention will be described. However, the Examples do not limit the present invention. In addition, in example, part number represents a mass part.

Magnetic Material Production Example 1

Aluminum sulfate was added to an aqueous ferrous sulfate solution so that the Al content in a base magnetic material was 0.60 mass % and magnesium hydroxide was added so that Mg content in the base magnetic material was 500 ppm, an aqueous sodium hydroxide to prepare an aqueous solution containing ferrous hydroxide solution was mixed with the resultant solutions. While adjusting the pH of the aqueous solution to 11 or higher, air was blown into the aqueous solution and an oxidation reaction are conducted at 90° C. to obtain slurry containing the base magnetic material.

Next, after aluminum sulfate was added to slurry containing the base magnetic material so that the Al content in a coating layer was 0.50 mass % (with respect to the magnetic material), the mixture was stirred at 80° C. and the pH was adjusted to 11 or higher, the magnesium hydroxide was added so that the Mg content in the coating layer was 900 ppm (with respect to the magnetic material), and the mixture was stirred for at least 15 minutes. After that, an aqueous sulfuric acid solution was added, the pH thereof was adjusted to 8 to 10, and the mixture was stirred for 5 minutes. An aqueous sulfuric acid solution was again added, to gradually decrease the pH thereof to finally 7.1. The slurry was washed, filtered, and then dried to obtain a magnetic material 1, in which, a coating layer composed of Al and Mg was formed on the surface of the base magnetic material containing Al and Mg. The resultant magnetic material 1 had a number-average particle size diameter (D1) of 0.16 μm, contained Al and Mg, and was composed of magnetic iron oxide whose crystal structure was magnetite. The physical properties of the magnetic material 1 are given in Table 1.

Magnetic Material Production Example 2

In Magnetic Material Production Example 1, in a step of producing the base magnetic material, the aluminum sulfate amount and the magnesium hydroxide amount were respectively changed so that the Al content in the base magnetic material became 1.20 mass % and the Mg content in the base magnetic material became 100 ppm. Further, in a step of forming the coating layer, the aluminum sulfate amount and the magnesium hydroxide amount were respectively changed so that the Al content in the coating layer became 1.50 mass % and the Mg content in the coating layer became 650 ppm. Under conditions where the above points were changed, a magnetic material was produced to obtain a magnetic material 2. The resultant magnetic material 2 had a number-average particle diameter (D1) of 0.17 μm, contained Al and Mg, and was composed of magnetic iron oxide whose crystal structure was magnetite. The physical properties of the magnetic material 2 are given in Table 1.

Magnetic Material Production Example 3

In Magnetic Material Production Example 1, in the step of producing the base magnetic material, the aluminum sulfate amount was changed so that the Al content in the base magnetic material became 1.00 mass % and the magnesium hydroxide was not used. Moreover, the pH of the aqueous solution was changed to 10.5. Further, in the step of forming the coating layer, the aluminum sulfate amount and the magnesium hydroxide amount were respectively changed so that the Al content in the coating layer became 1.20 mass %, and the Mg content in the coating layer became 150 ppm. Under conditions where the above points were changed, a magnetic material was produced to obtain a magnetic material 3. The resultant magnetic material 3 had a number-average particle diameter (D1) of 0.15 μm, contained Al and Mg, and was composed of magnetic iron oxide whose crystal structure was magnetite. The physical properties of the magnetic material 3 are given in Table 1.

Magnetic Material Production Example 4

In Magnetic Material Production Example 1, in the step of producing the base magnetic material, the aluminum sulfate amount was changed so that the Al content in the base magnetic material became 0.50 mass % and the magnesium hydroxide was not used. Moreover, the pH of the aqueous solution was changed to 10.5. Further, in the step of forming the coating layer, the aluminum sulfate amount and the magnesium hydroxide amount were respectively changed so that the Al content in the coating layer became 0.40 mass % and the Mg content in the coating layer became 100 ppm. Under conditions where the above points were changed, a magnetic material was produced to obtain a magnetic material 4. The resultant magnetic material 4 had a number-average particle size diameter (D1) of 0.20 μm, contained Al and Mg, and was composed of magnetic iron oxide whose crystal structure was magnetite. The physical properties of the magnetic material 4 are given in Table 1.

Magnetic Material Production Example 5

In Magnetic Material Production Example 1, in the step of producing the base magnetic material, the aluminum sulfate amount and the magnesium hydroxide amount were respectively changed so that the Al content in the base magnetic material became 0.20 mass %, and the Mg content in the base magnetic material became 100 ppm. Further, in the step of forming the coating layer, the aluminum sulfate amount was changed so that the Al content in the coating layer became 0.30 mass %, and magnesium hydroxide was not used. Under conditions where the above points were changed, a magnetic material was produced to obtain a magnetic material 5. The resultant magnetic material 5 had a number-average particle size diameter (D1) of 0.18 μm, contained Al and Mg, and was composed of magnetic iron oxide whose crystal structure was magnetite. The physical properties of the magnetic material 5 are given in Table 1.

Magnetic Material Production Example 6

In Magnetic Material Production Example 1, in the step of producing the base magnetic material, the aluminum sulfate amount was changed so that the Al content in the base magnetic material became 2.20 mass % and the magnesium hydroxide was not used. Moreover, the pH of the aqueous solution was changed to 10.5 and the stirring rate is reduced. Further, in the step of forming the coating layer, the aluminum sulfate amount was changed so that the Al content in the coating layer became 2.80 mass %, and magnesium hydroxide was not used. Under conditions where the above points were changed, a magnetic material was produced to obtain a magnetic material 6. The resultant magnetic material 6 had a number-average particle size diameter (D1) of 0.30 μm, contained Al, and was composed of magnetic iron oxide whose crystal structure was magnetite. The physical properties of the magnetic material 6 are given in Table 1.

Magnetic Material Production Example 7

In Magnetic Material Production Example 1, in the step of producing the base magnetic material, the aluminum sulfate amount was changed so that the Al content in the base magnetic material became 0.30 mass % and the magnesium hydroxide was not used. Moreover, the pH of the aqueous solution was changed to 10.5. Further, in the step of forming the coating layer, the aluminum sulfate amount was changed so that the Al content in the coating layer became 0.20 mass %, and magnesium hydroxide was not used. Under conditions where the above points were changed, a magnetic material was produced to obtain a magnetic material 7. The resultant magnetic material 7 had a number-average particle size diameter (D1) of 0.15 μm, contained Al, and was composed of magnetic iron oxide whose crystal structure was magnetite. The physical properties of the magnetic material 7 are given in Table 1.

Magnetic Material Production Example 8

In Magnetic Material Production Example 1, a magnetic material 8 was obtained without adding Al and Mg. However, by adjusting the pH of the aqueous solution, the shape of the resultant magnetic iron oxide was made to be octahedral. The physical properties of the magnetic material 8 are given in Table 1.

Magnetic Material Production Example 9

In Magnetic Material Production Example 1, in the step of producing the base magnetic material, the aluminum sulfate amount was changed so that the Al content in the base magnetic material became 2.00 mass % and the magnesium hydroxide was not used. Moreover, the pH of the aqueous solution was changed to 10.5 and the stirring rate is reduced. Further, in the step of forming the coating layer, the aluminum sulfate amount was changed so that the Al content in the coating layer became 3.30 mass %, and magnesium hydroxide was not used. Under conditions where the above points were changed, a magnetic material was produced to obtain a magnetic material 9. The resultant magnetic material 9 had a number-average particle diameter (D1) of 0.22 μm, contained Al, and was composed of magnetic iron oxide whose crystal structure was magnetite. The physical properties of the magnetic material 9 are given in Table 1.

Magnetic Material Production Example 10

In Magnetic Material Production Example 1, in a step of producing the base magnetic material, the aluminum sulfate amount and the magnesium hydroxide amount were respectively changed so that the Al content in the base magnetic material became 0.40 mass % and the Mg content in the base magnetic material became 70 ppm. Moreover, the reaction temperature in the oxidation reaction was changed to 80° C. Further, in a step of forming the coating layer, the aluminum sulfate amount and the magnesium hydroxide amount were respectively changed so that the Al content in the coating layer became 0.60 mass % and the Mg content in the coating layer became 50 ppm. Moreover, the stirring time was changed to 10 minutes. Further, after the stirring, the pH was changed to decrease to 7.1 without stirring for 5 minutes at pH 8 to 10. Under conditions where the above points were changed, a magnetic material was produced to obtain a magnetic material 10. The resultant magnetic material 10 had a number-average particle size diameter (D1) of 0.16 μm, contained Al and Mg, and was composed of magnetic iron oxide whose crystal structure was magnetite. The physical properties of the magnetic material 10 are given in Table 1.

TABLE 1

| | Dielectric breakdown voltage (V/cm) | Number-average particle diameter (μm) | Al content (mass %) | Mg content (ppm) | Al dissolution percentage when washed by NaOH S1 (mass %) | Al dissolution percentage when Fe dissolution percentage is 20% S2 (mass %) | Al dissolution percentage when Fe dissolution percentage is 60% S3 (mass %) | Al dissolution percentage when Fe dissolution percentage is 80% S4 (mass %) | Isoelectric point | Volume resistance (Ωcm) | Strength of magnetization $\sigma_{10k}$ ($Am^2/kg$) | Residual magnetization σr ($Am^2/kg$) | Coercive force Hc (kA/m) |
|---|---|---|---|---|---|---|---|---|---|---|---|---|---|
| Magnetic material 1 | 800 | 0.16 | 1.10 | 1400 | 51 | 82 | 94 | 99 | 9.3 | $2.2 \times 10^8$ | 83.5 | 6.8 | 6.4 |
| Magnetic material 2 | 860 | 0.17 | 2.70 | 800 | 42 | 64 | 87 | 97 | 9.8 | $3.1 \times 10^8$ | 80.3 | 5.8 | 4.6 |
| Magnetic material 3 | 520 | 0.15 | 2.20 | 150 | 55 | 69 | 85 | 95 | 8.9 | $1.3 \times 10^8$ | 82.4 | 6.7 | 5.3 |
| Magnetic material 4 | 375 | 0.20 | 0.90 | 100 | 44 | 80 | 92 | 96 | 7.5 | $1.0 \times 10^8$ | 85.0 | 7.3 | 6.7 |
| Magnetic material 5 | 160 | 0.18 | 0.50 | 100 | 52 | 74 | 89 | 92 | 7.0 | $8.8 \times 10^7$ | 86.6 | 6.6 | 6.3 |
| Magnetic material 6 | 1040 | 0.30 | 5.00 | 100 | 56 | 70 | 82 | 90 | 8.9 | $1.8 \times 10^7$ | 81.0 | 7.8 | 7.0 |
| Magnetic material 7 | 50 | 0.15 | 0.50 | 0 | 38 | 89 | 95 | 99 | 6.9 | $9.4 \times 10^7$ | 86.9 | 6.5 | 5.2 |
| Magnetic material 8 | 40 | 0.23 | 0.00 | 0 | — | — | — | — | 6.5 | $2.8 \times 10^5$ | 87.3 | 10.1 | 6.3 |
| Magnetic material 9 | 120 | 0.22 | 5.30 | 0 | 63 | 80 | 96 | 97 | 10.3 | $8.2 \times 10^6$ | 87.6 | 5.8 | 7.2 |
| Magnetic Material 10 | 150 | 0.16 | 1.00 | 120 | 58 | 66 | 83 | 92 | 8.0 | $1.4 \times 10^7$ | 80.1 | 7.5 | 5.5 |

Binder Resin Production Example 1

| (Polyester Resin A) | |
|---|---|
| Bisphenol derivative represented by the formula (B) (R: propylene group, average value of (x + y): 2.2) | 39 parts |
| Bisphenol derivative represented by the formula (B) (R: propylene group, average value of (x + y): 2.2) | 18 parts |
| Terephthalic acid | 20 parts |
| Isophthalic acid | 11 parts |
| Fumaric acid | 0.2 parts |
| Dodecenylsuccinic anhydride | 12 parts |

0.1 mass % of tetrabutyl titanate as a catalyst was added to these component and condensation polymerization was conducted at 230° C. to obtain a low molecular weight unsaturated polyester resin A with no THF-insoluble component (Tg: 59° C., and peak molecular weight (Mp): 7,800).

After 75 parts of the resultant low molecular weight unsaturated polyester resin A was dissolved in 75 parts of methyl ethyl ketone with heating and cooled, 19 parts of styrene, 6 parts of butyl acrylate, and 0.125 parts of PARKADOX 12-XL25 (made by Kayaku Akzo Corp.) as a polymerization initiator were mixed thereto. The monomer-containing polyester solution was added to 150 parts of a 0.2 mass % aqueous polyvinyl alcohol solution while stirring and dispersed to obtain a suspension.

The resultant suspension was heated under nitrogen flow to increase temperature while methyl ethyl ketone was refluxed. While the temperature inside a flask was kept at 85° C. and methyl ethyl ketone was distilled off, the suspension was subjected to polymerization for 20 hours and then cooled. The resultant suspended slurry was dehydrated and dried to obtain a hybrid resin (Tg: 59° C., THF-insoluble component: 40 mass %, Mp: 7,700, Mn: 3,500, Mw: 26,000, acid value: 18 mg KOH/g, and hydroxyl value: 35 mg KOH/g). This is represented as binder resin 1.

Binder Resin Production Example 2

| (Polyester Resin B) | |
|---|---|
| Terephthalic acid | 25 parts |
| Trimellitic anhydride | 3 parts |
| Bisphenol derivative represented by the formula (B) (R: propylene group, average value of (x + y): 2.2) | 72 parts |

0.5 parts of dibutyltin oxide as a catalyst was added to these components, and condensation polymerization was conducted at 220° C. to obtain a low molecular weight polyester resin B (Tg: 55° C., THF-insoluble component: 0 mass %, Mp: 7,600, Mn: 4,000, Mw: 9,200, acid value: 11 mg KOH/g, and hydroxyl value: 35 mg KOH/g).

| (Polyester Resin C) | |
|---|---|
| Terephthalic acid | 18 parts |
| Isophthalic acid | 3 parts |
| Trimellitic anhydride | 7 parts |
| Bisphenol derivative represented by the formula (B) (R: propylene group, average value of (x + y): 2.2) | 72 parts |
| Oxyalkyleneether of novolac-type phenolic resin represented by the formula (D) (R: ethylene group, average value of x: 2.2, average value of y1 to y3: 1.0) | 2 parts |

0.5 parts by mass of dibutyltin oxide as a catalyst was added to these raw materials, and condensation polymerization was conducted at 240° C. to obtain a crosslinked polyester resin C (Tg: 56° C., THF-insoluble component: 39 mass %, Mp: 8,600, Mn: 5,300, Mw: 110,000, acid value: 25 mg KOH/g, and hydroxyl value: 21 mg KOH/g).

Next, 50 parts of the resultant polyester resin C and 50 parts of the resultant polyester resin B were pre-mixed using a Henschel Mixer (mixer: made by Mitsui Mining & Smelting Co., Ltd.); and kneaded using a KRC Kneader S1 (kneader: made by Kurimoto Tekkosho K.K.) under a condition so that the temperature of the discharged resin became 150° C. to obtain a binder resin 2 (Tg: 56° C., THF-insoluble component: 22 mass %, Mp: 8,800, Mn: 5,600, Mw: 130,000, acid value: 16 mg KOH/g, and hydroxyl value: 27 mg KOH/g).

Binder Resin Production Example 3

A styrene-acryl resin (styrene/n-butylacrylate/maleic anhydride=50/45/5 (by mole scale)) having Tg: 58° C., peak molecular weight (Mp): 7,800, number average molecular weight (Mn): 5,000, weight average molecular weight (Mw): 9,700, acid value: 21 mg KOH/g, and hydroxyl value: 2 mg KOH/g, was used as a binder resin 3.

Example 1

| | |
|---|---|
| Binder resin 1 | 100 parts |
| Magnetic material 1 | 90 parts |
| Fischer-Tropsch wax (melting point: 108° C.) | 4 parts |
| Charge control agent: T-77 (an azo iron compound, made by Hodogaya Chemical Industries Co., Ltd.) | 2 parts |

The above mixture was molten and kneaded using a twin screw extruder heated at 140° C., the resultant cooled kneaded mixture was coarsely pulverized using a hammer mill, the resultant coarsely pulverized mixture was finely pulverized using a Jet mill, and the resultant finely pulverized powder was classified using a fixed-wall type pneumatic classifier to produce a primary classified powder. The resultant primary classified powder was further strictly classified to eliminate simultaneously ultra-fine powder and coarse powder using a multi-division classifier utilizing the Coanda effect (Elbow Jet Classifier, made by Nittetsu Kogyo K.K.), thus resulting in negatively chargeable magnetic toner particles whose weight-average particle diameter (D4) is 5.7 μm. To 100 parts of the resultant magnetic toner particles, 1.2 parts of hydrophobic silica fine powder which was subjected to a hydrophobizing treatment and whose BET specific surface area is 120 $m^2/g$ were externally added to prepare a magnetic toner 1.

As an image sheet outputting test machine for evaluating the magnetic toner 1, a modified machine of a commercially available LBP printer (HP LaserJet 4250, made by Hewlett Packard) was used. Specifically, the machine was modified so that the processing speed thereof became 120 mm/sec (20 sheets/minute in lateral A4 size), and further modified so that peripheral speeds of a developing sleeve and an electrostatic latent image bearing member became same. A stirring member provided to a position apart from the developing sleeve, among toner stirring members provided in a cartridge, was removed. Using the test machine, printing test of 20,000 sheets was performed under environments of 30° C. and 80% RH (high temperature and high humidity) and of 15° C. and 10% RH (low temperature and low humidity), and evaluations as shown below were performed. The evaluation results are given in Table 3.

(1) Image Density

By printing out images on 20,000 sheets of plain paper (75 $g/m^2$) for usual copying machines under both of a high temperature and high humidity environment and a low temperature and low humidity environment, image density was evaluated at a time of end. In addition, with regard to the image density, relative density of a blank part whose original density was 0.00 (that is a plain paper for copying machines before an image was formed thereon) with respect to a printed out image was measured using a Macbeth Densitometer (made by Macbeth Co.) with a SPI filter. After leaving for 2 weeks under an environment of high temperature and high humidity, the image density of printing out image on the first sheet was evaluated.

(2) Sleeve Negative Ghost

By printing out images on 20,000 sheets of plain paper (75 $g/m^2$) for usual copying machines under an low temperature and low humidity environment, evaluations of a sleeve negative ghost were performed every 5,000 sheets. When an image evaluation was performed with regard to a ghost, after solid-black belt images were printed out by one round of the sleeve, halftone images were printed out. In a sheet of printed image, difference in reflection density, measured by the Macbeth Reflection Densitometer, between a part where the black images were formed (solid-black printed areas) on the first round of the sleeve and a part where no black image was formed (non-image areas) on the first round of the sleeve was calculated on a part corresponding to the second round of the sleeve using the following formula.

Difference in reflection density=reflection density (of a part where no image was formed)−reflection density (of a part where images were formed)

In addition, it is indicated that as the difference in reflection density becomes smaller, a ghost hardly occurs, and a good sleeve ghost level can be thereby obtained. The resultant differences in reflection density were evaluated by being divided into the following four grades:

A: differences in reflection density were smaller than 0.02,

B: differences in reflection density were equal to or greater than 0.02 and smaller than 0.04, C: differences in reflection density were equal to or greater than 0.04 and smaller than 0.06, and D: differences in reflection density were equal to or greater than 0.06, and the worst evaluation results among evaluation results of every 5,000 sheets of images were evaluated.

(3) Fogging

With regard to fogging, the fogging was measured by means of the following described below with respect to the second sheet of image by setting the amplitude of an AC component of a developing bias to 1.8 kV (default was 1.6 kV) and printing two sheets of solid-white images when 10,000 sheets of images were printed in a durability test under a low temperature and low humidity environment.

The reflection densities of transfer materials were measured before and after an image was formed using a reflectodensitometer (Reflectometer TC-6DS, made by Tokyo Denshoku K.K.), the worst value of the reflection densities after an image was formed was set as Ds and the average reflection density of the transfer materials before an image was formed was set as Dr, and (Ds-Dr) was obtained, which was evaluated as a fogging amount. The lower value indicates that fogging is smaller.

The evaluation criteria of the fogging is indicated below:

A: smaller than 1.0,

B: equal to or greater than 1.0 and smaller than 2.0,

C: equal to or greater than 2.0 and smaller than 3.5, and

D: equal to or greater than 3.5.

(4) Scattering

With regard to scatterings, images obtained after a durability test under a low temperature and low humidity environment were evaluated using an original including lines and letters by means of viewing or a magnifying glass, on the basis of the following criteria:

A: letter images and line images were faithfully reproduced in detail,

B: a level where although a certain amount of disturbances and scatterings were occurred when observed in detail, there was no problem in viewing.

C: a level where disturbances and scatterings could be identified even by means of viewing, and D: many disturbances and scatterings occurred and the original was not reproduced.

Examples 2 to 6

Magnetic toners 2 to 6 were produced by means of the same method as that in Example 1 except for changing a magnetic material, a binder resin, and wax of the magnetic toner formulations to those as given in Table 2.

Moreover, using the resultant magnetic toners respectively, the same evaluations as those in Example 1 were performed. The evaluation results are given in Table 3.

Comparative Example 1

A magnetic toner 7 was produced by means of the same method as that in Example 1 except for changing the formulation of a magnetic toner to that as given in Table 2.

Moreover, using the resultant magnetic toner 7, the same evaluations as those in Example 1 were performed. The evaluation results are given in Table 3.

Comparative Example 2

A magnetic toner 8 was produced by means of the same method as that in Example 1 except for changing the formulation of a magnetic toner to that as given in Table 2 and the kneading temperature during melting and kneading to a temperature of 100° C.

Moreover, using the resultant magnetic toner 8, the same evaluations as those in Example 1 were performed. The evaluation results are given in Table 3.

Comparative Example 3

A magnetic toner 9 was produced by means of the same method as that in Example 1 except for changing the formulations of a magnetic toner to that as given in Table 2, and the amount of the magnetic material to 50 parts.

Moreover, using the resultant magnetic toner 9 the same evaluations as those in Example 1 were performed. The evaluation results are given in Table 3.

Comparative Example 4

A magnetic toner 10 was produced by means of the same method as that in Example 1 except for changing the formulation of a magnetic toner to that as given in Table 2, the addition amount of a magnetic toner from 90 parts to 120 parts and the kneading temperature during melting and kneading from 140 to 160° C.

Moreover, using the resultant magnetic toner 10, the same evaluations as those in Example 1 were performed. The evaluation results are given in Table 3.

Comparative Example 5

A magnetic toner 11 was produced by means of the same method as that in Example 1 except for changing the formulation of a magnetic toner to that as given in Table 2, the addition amount of a magnetic toner from 90 parts to 60 parts and the kneading temperature during melting and kneading from 140 to 120° C.

Moreover, using the resultant magnetic toner 11, the same evaluations as those in Example 1 were performed. The evaluation results are given in Table 3.

Comparative Example 6

A magnetic toner 12 was produced by means of the same method as that in Example 1 except for changing the formulation of a magnetic toner to that as given in Table 2.

Moreover, using the resultant magnetic toner 12, the same evaluations as those in Example 1 were performed. The evaluation results are given in Table 3.

Comparative Example 7

A magnetic toner 13 was produced by means of the same method as that in Example 1 except for changing the formulation of a magnetic toner to that as given in Table 2.

Moreover, using the resultant magnetic toner 13, the same evaluations as those in Example 1 were performed. The evaluation results are given in Table 3.

TABLE 2

| | | | Wax | | | Dielectric loss | Weight-average |
|---|---|---|---|---|---|---|---|
| | Magnetic material | Binder resin | Kind | Melting point (° C.) | Mn | tangent tanδ | particle diameter (μm) |
| Example 1 | Magnetic material 1 | Binder resin 1 | Fischer-Tropsch wax | 108 | 750 | $7.1 \times 10^{-3}$ | 5.7 |
| Example 2 | Magnetic material 2 | Binder resin 2 | Higher alcohol wax | 96 | 583 | $6.5 \times 10^{-3}$ | 6.5 |

TABLE 2-continued

| | Magnetic material | Binder resin | Wax Kind | Wax Melting point (° C.) | Wax Mn | Dielectric loss tangent tanδ | Weight-average particle diameter (μm) |
|---|---|---|---|---|---|---|---|
| Example 3 | Magnetic material 3 | Binder resin 2 | Fischer-Tropsch wax | 108 | 750 | $6.7 \times 10^{-3}$ | 5.5 |
| Example 4 | Magnetic material 4 | Binder resin 1 | Polyethylene wax | 115 | 1354 | $7.5 \times 10^{-3}$ | 8.3 |
| Example 5 | Magnetic material 5 | Binder resin 2 | Paraffin wax | 70 | 362 | $6.7 \times 10^{-3}$ | 6.9 |
| Example 6 | Magnetic material 6 | Binder resin 3 | Polyethylene wax | 115 | 1354 | $8.2 \times 10^{-3}$ | 4.9 |
| Comparative Example 1 | Magnetic material 7 | Binder resin 1 | Paraffin wax | 70 | 362 | $1.9 \times 10^{-3}$ | 7.3 |
| Comparative Example 2 | Magnetic material 8 | Binder resin 2 | Polypropylene wax | 142 | 7850 | $1.1 \times 10^{-2}$ | 8.9 |
| Comparative Example 3 | Magnetic material 9 | Binder resin 3 | Polypropylene wax | 142 | 7850 | $5.5 \times 10^{-3}$ | 10.1 |
| Comparative Example 4 | Magnetic material 1 | Binder resin 1 | Fischer-Tropsch wax | 108 | 750 | $2.5 \times 10^{-2}$ | 6.1 |
| Comparative Example 5 | Magnetic material 1 | Binder resin 1 | Fischer-Tropsch wax | 108 | 750 | $1.6 \times 10^{-3}$ | 5.5 |
| Comparative Example 6 | Magnetic material 7 | Binder resin 2 | Fischer-Tropsch wax | 108 | 750 | $4.9 \times 10^{-3}$ | 5.7 |
| Comparative Example 7 | Magnetic material 10 | Binder resin 1 | Fischer-Tropsch wax | 108 | 750 | $8.5 \times 10^{-3}$ | 5.9 |

TABLE 3

| | Image density after endurance | | | Evaluation under a low temperature and low humidity environment | | |
|---|---|---|---|---|---|---|
| | High temperature high humidity | Low temperature low humidity | After leaving 2 weeks | Ghost | Fogging | Scattering |
| Example 1 | 1.49 | 1.50 | 1.47 | A | A | A |
| Example 2 | 1.47 | 1.46 | 1.46 | B | A | A |
| Example 3 | 1.46 | 1.48 | 1.45 | B | A | B |
| Example 4 | 1.39 | 1.42 | 1.37 | B | B | B |
| Example 5 | 1.43 | 1.40 | 1.40 | B | B | B |
| Example 6 | 1.40 | 1.41 | 1.40 | B | B | C |
| Comparative Example 1 | 1.40 | 1.32 | 1.34 | C | B | C |
| Comparative Example 2 | 1.34 | 1.39 | 1.25 | C | D | D |
| Comparative Example 3 | 1.30 | 1.28 | 1.22 | D | C | D |
| Comparative Example 4 | 1.45 | 1.48 | 1.42 | C | C | D |
| Comparative Example 5 | 1.43 | 1.43 | 1.42 | C | D | C |
| Comparative Example 6 | 1.41 | 1.37 | 1.37 | B | B | C |
| Comparative Example 7 | 1.38 | 1.41 | 1.13 | B | C | B |

This application claims the benefit of Japanese Patent Application No. 2006-124750 filed Apr. 28, 2006, which is hereby incorporated by reference herein in its entirety.

The invention claimed is:

1. A magnetic toner comprising at least a binder resin and a magnetic material, wherein the magnetic material is magnetic iron oxide whose dielectric breakdown voltage is 160 to 1600 V/cm, the dielectric loss tangent (tan δ) of the magnetic toner at 100 kHz and 40° C. is $2.0\times10^{-3}$ to $1.0\times10^{-2}$, the magnetic material contains aluminum (Al) at an amount of 0.5 to 5.0 mass %, the aluminum dissolution percentage with respect to the total Al content of the magnetic material is 40 to 60 mass %, when the magnetic material is washed with a 1 mol/L aqueous sodium hydroxide solution, the aluminum dissolution percentage with respect to the total Al content of the magnetic material is 60 to 85 mass %, when the magnetic material is dissolved in a 1 mol/L aqueous hydrochloric acid solution so that the iron dissolution percentage with respect to the total iron content of the magnetic material is 20 mass %, the aluminum dissolution percentage with respect to the total Al content of the magnetic material is 80 to 95 mass %, when the magnetic material is dissolved in a 1 mol/L aqueous hydrochloric acid solution so that the iron dis solution percentage with respect to the total iron content of the magnetic material is 60 mass %, and the aluminum dissolution percentage with respect to the total Al content of the magnetic material is 95 to 99 mass %, when the magnetic material is dissolved in a 1 mol/L aqueous hydrochloric acid solution so that the iron dissolution percentage with respect to the total iron content of the magnetic material is 80 mass %.

2. The magnetic toner according to claim 1, wherein the isoelectric point of the magnetic material is pH 7.0 or more and pH 10.0 or less.

3. The magnetic toner according to claim 1, wherein the binder resin is a resin having at least a polyester unit.

* * * * *